US005776249A

United States Patent [19]

Rutz

[11] Patent Number: 5,776,249

[45] Date of Patent: Jul. 7, 1998

[54] POWDER SPRAY COATING DEVICE

[75] Inventor: Guido Rutz, Gossau, Switzerland

[73] Assignee: Gema Volstatic AG, Switzerland

[21] Appl. No.: 770,318

[22] Filed: Dec. 20, 1996

[30] Foreign Application Priority Data

Dec. 23, 1995 [DE] Germany ..... 195 48 607.2

[51] Int. Cl.[6] ..... B05B 7/00; B05C 5/00; B05C 19/00

[52] U.S. Cl. ..... 118/308; 118/300; 118/663; 118/676; 118/679; 118/684; 118/685; 118/620; 118/621; 239/407

[58] Field of Search ..... 118/300, 308, 118/663, 676, 679, 684, 685, 620, 621; 239/398, 407, 569; 137/625, 625.47, 625.48, 875, 876, 887

[56] References Cited

U.S. PATENT DOCUMENTS

| | | | |
|---|---|---|---|
| 3,450,092 | 6/1969 | Kock | 118/707 |
| 3,674,205 | 7/1972 | Kock | 239/569 |
| 4,077,354 | 3/1978 | Walberg | 118/629 |
| 4,284,032 | 8/1981 | Moos et al. | 118/684 |
| 4,561,380 | 12/1985 | Mulder et al. | 118/688 |
| 5,131,350 | 7/1992 | Buschor | 118/308 |
| 5,558,713 | 9/1996 | Siegfried et al. | 118/308 |

FOREIGN PATENT DOCUMENTS

| | | | |
|---|---|---|---|
| 412289 | 2/1991 | European Pat. Off. . | |
| 579012 | 1/1994 | European Pat. Off. | 118/300 |
| 636420 | 2/1995 | European Pat. Off. . | |
| 1358998 | 12/1987 | U.S.S.R. | 118/676 |

*Primary Examiner*—Laura Edwards
*Assistant Examiner*—Michael Colaianni
*Attorney, Agent, or Firm*—MacMillan, Sobanski & Todd

[57] ABSTRACT

A powder spray coating device which includes an injector air flow controller having two alternate air flow paths for delivering feed air to an injector which delivers powder to a spray device. Optionally, the air flow controller also may have two alternate air flow paths for delivering supplemental air to the injector or downstream from the injector. In a first setting of a mode selector, feed air is delivered through a manually adjusted air valve and in a second setting of the mode selector the feed air is delivered through an automatically adjusted air valve. When supplemental air is provided, the supplemental air passes through a manually adjusted air valve in the first mode selector setting and through an automatically adjusted air valve in the second mode selector setting. A controller may detect articles to be coated and set the automatically adjusted feed air and supplemental air valves.

9 Claims, 4 Drawing Sheets

POWDER SPRAY COATING DEVICE

BACKGROUND OF THE INVENTION

Electrostatic powder spray coating devices are know, for example, from European patent EP-B 0 412 489. The prior art device comprises an injector which pneumatically feeds coating powder from a powder container to a spray device. A feed air line connected to the injector is provided with an adjustable first pressure adjustment device or valve for adjusting the powder feed rate. A supplemental air line connected to the injector is provided with an adjustable second pressure setting device or valve. An air feed line feeds compressed air to both pressure setting devices.

A first flow meter is arranged in the air feed line for displaying the total amount of feed air and supplemental air. A second supplemental air line, or scavenging air line, may be connected directly to the spray device. This air may flow, for example, over an electrode which electrostatically charges the powder to keep the powder particles away from the electrode and to prevent the powder particles from clinging to the electrode. The pressure setting valves may be adjustable pressure regulators, adjustable flow restrictors, adjustable cocks or the like. Although air is the preferred medium, other gases also may be used. The powder quantity delivered by the injector depends on the amount of feed air delivered to it. The powder feed amount also depends on the amount of supplemental air, if the supplemental air is introduced into a vacuum area of the injector. Frequently, however, the supplemental air is supplied to the feed air/powder flow downstream of the vacuum area. Therefore, the supplemental air can serve two different purposes, namely, it can influence the powder feed rate and/or the powder flow velocity downstream of the injector.

For feeding very small amounts of powder per unit time, it may be necessary to reduce the feed air flow to the point that powder deposits occur in the line downstream of the injector. In this case, the flow velocity can be increased by supplying supplemental air. Air is required for feeding the powder. However, a strong airflow causes the powder applied on an object being coated to be blown off again. Therefore, it is advantageous to adjust not only the air required to feed a specific powder quantity, but also to take care that the total amount of air remains within an optimum range. This is made possible for the operator by watching the total air flow rate on the flow meter that is arranged in the joint feed air and supplemental air feed line.

Preferably, the spray devices are designed to impart an electrostatic charge to the coating material. If the powder is electrostatically charged relative to a grounded article being coated, the powder will be attracted to and cling better to the object before the powder is melted to the article. Fewer of the charged particles will miss the article due to scattering. The electrostatic charge can be triboelectrically generated by friction of the powder particles moving along supply duct walls in the spray device, or by a high voltage on an electrode arranged in or beside the flow path of the coating powder. The voltage generator for supplying a high voltage to the electrode may be arranged externally or within the spray device. An exemplary electrostatic HV spray coating device is shown, for example, in U.S. Pat. No. 4,196,465.

Articles are normally coated with powder in a spray booth through which the articles are conveyed. Spray guns are introduced through openings in the walls of the spray booth. When switching from one powder type to another, notably when changing powder colors, all powder flow paths must be cleaned and also the flow rate of feed air and supplemental air required for the second coating must be adjusted to new optimum values. Similar adjustments also are needed when changing from one type of articles to another and when changing the feed rate at which the articles are conveyed through the spray booth. These adjustments require significant time of a skilled operator. The operator uses specific tables and visual observations of the powder cloud being sprayed and of the coating results to obtain what is judged to be the optimum values for the feed air and the supplemental air. Significant coating powder can be lost during the adjustment work and the powder must be blown off the poorly coated articles with compressed air before the final coating can be applied.

BRIEF SUMMARY OF THE INVENTION

According to the invention, an electrostatic powder spray coating device is provided with two operating modes for controlling the flow of feed air and supplemental air, namely, a manual mode and an automatic mode. In the automatic mode, air flow rates are stored in a controller for different coating powders, for different articles to be coated and/or for different conveying rates at which the articles are moved through a spray booth or other coating station.

The invention enables operation of the powder spray coating device selectively by manual or automatic operation with a number of advantages over the prior art. The operator may, as with the prior art, manually adjust the feed air and the supplemental air flow rates to obtain what the operator believes to be optimal for coating a specific article. Moreover, if the automatic operation is not satisfactory, changeover to manual operation is possible at any time. The optimum values for feed air and supplemental air as determined by the operator or by the manufacturer of the powder spray coating device may be stored for several different articles in the controller that is provided for automatic operation. The pressures and flow rates of feed air and supplemental are stored and automatically set by the controller in the automatic operation mode for the respective article. The operator no longer needs to manually set all of the individual values when changing over to a different powder type. The specific powder type only needs to be selected on the controller. Similarly, the article type and/or the article conveyor rate can be selected on the controller when switching to coating different articles. The controller then automatically sets the correct pressures and flow rates for feed air and for supplemental air. Considering the fact that a spray coating system normally may include several spray devices, each of which requires individual settings for pressures and flow rates of feed air and of supplemental air, it can be easily seen that the invention offers a significant time savings in that only the powder type, the type of article and the article feed rate need to be chosen on the controller. Different types of articles are frequently coated successively in a spray booth. In this case, the invention makes it possible to arrange in the feed path of the articles an article sensor connected to the controller for reporting the presence and/or type of article. Depending on such sensor signal, the controller can automatically transmit appropriate signals to valves for automatic adjustment of the feed air and of the supplemental air. The controller is preferably computerized and includes memories which store values for feed air, supplemental air and feed velocity required for various articles and/or various powder types and/or various article feed rates. These values may be pressures and/or flow rates and/or electric voltages.

Other objects and advantages of the invention will become apparent from the following detailed description of the invention and the accompanying drawings.

DETAILED DESCRIPTION OF THE INVENTION

Figure 1:
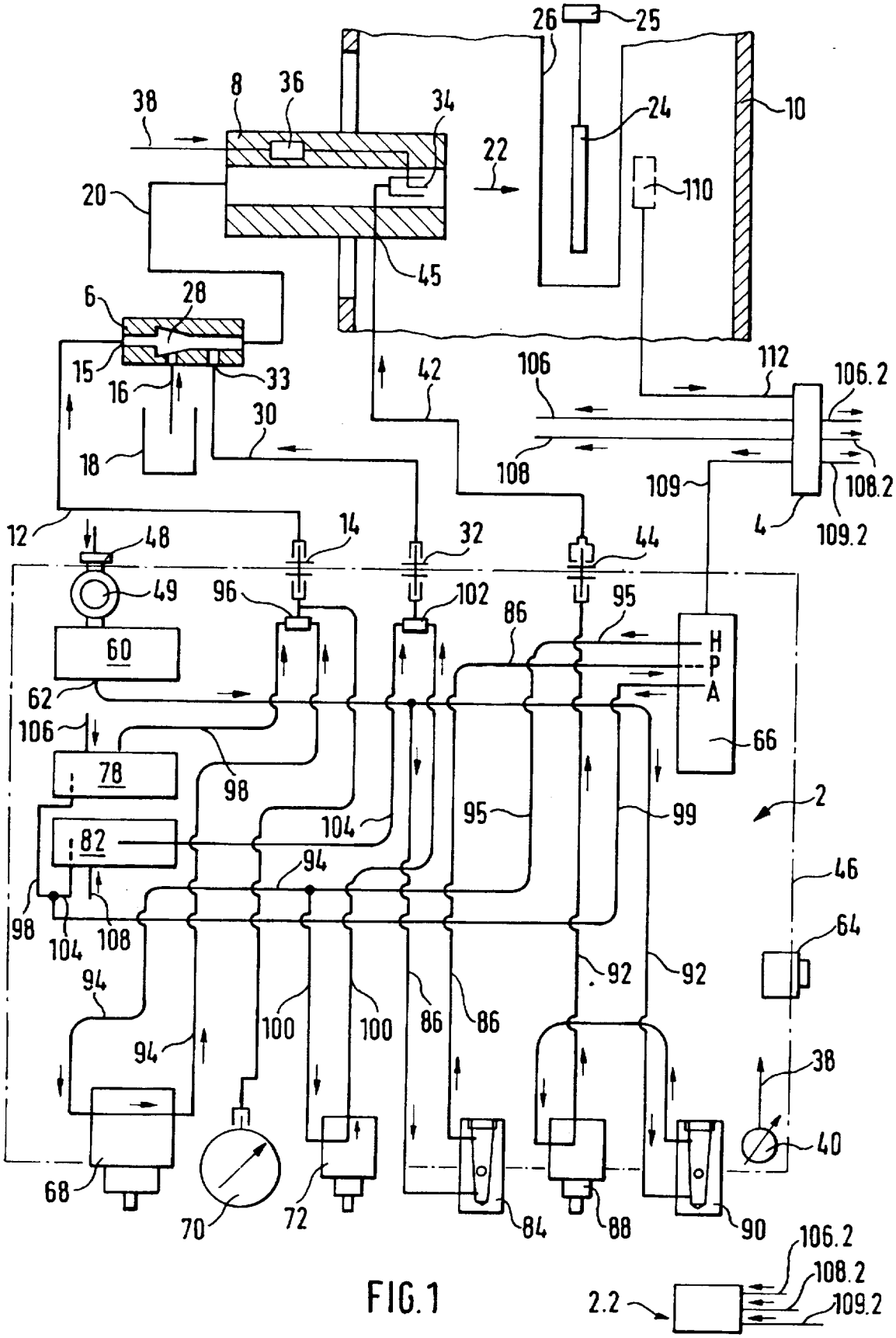
FIG. 1 is a schematic diagram of a powder spray coating device according to the invention.

FIG. 1 illustrates a powder spray coating device according to the invention including a controller 2, a master electronic control device 4, an injector 6, a powder spray device 8 and a spray booth 10. The injector 6 acts as a pneumatic powder pump which delivers fluidized coating powder to the spray device 8. A feed air line 12 connects a feed air outlet 14 on the controller 2 to a feed air inlet 15 on the injector 6. The feed air flow to the inlet 15 creates a vacuum in an area 28 of the injector 6 which draws powder from a powder container 18 through a suction line 16. The feed air flow carries the powder from the injector 6 through a powder line 20 to the spray device 8 which sprays the powder 22 on an article 24 in the spray booth 10. A conveyor 25 supports and transports the article 24 through a wall opening 26 in the spray booth, past the spray device 8 and out a second wall opening.

A supplemental air line 30 is connected from a supplemental air outlet 32 on the controller 2 to a supplemental air inlet 33 on the injector 6. The supplemental air line 30 delivers a flow of supplemental air either to the vacuum area 28 or downstream thereof to adjust the powder feed quantity and/or to adjust the amount of air flow in the powder line 20 to provide for an optimal quality coating. The supplemental air flow, for example, may increase the suction in the vacuum area 28 and/or it may increase the air flow carrying the powder to the spray device 8 through the line 20 to prevent powder buildup in the line 20, especially at low powder flow rates.

In order to maximize the powder transfer efficiency, namely, the percentage of sprayed powder which is actually deposited on the article 24, an electrostatic charge is imparted to the powder 22 relative to the article 24. The powder can be electrostatically charged in the spray device 8 either by friction between the flowing powder and the powder duct walls or, as shown in FIG. 1, by a high voltage electrode 34. A high voltage generator 36 may be integrated in the spray device 8 for applying a high voltage to the electrode 34. The high voltage generator 36 converts a low voltage received on an electric line or wire 38 to a desired high level. The high voltage electrode 34 is arranged in the powder flow path for transferring a charge to the powder as it passes through the spray device 8. The low voltage line 38 may be connected to a potentiometer 40 in the controller 2 so that the high voltage on the electrode 34 can be automatically turned on and off and the voltage level can be adjusted.

If the powder is allowed to move over the electrode 34 as it flows through the spray device 8, some powder may cling to and build up on the electrode 34. In order to prevent powder buildup on the electrode 34, the electrode 34 can be swept by a flow of air received from an electrode air line 42.

The electrode air line 42 is connected between an outlet 44 on the controller 2 and an electrode air inlet 45 on the spray device 8.

The controller 2 has a housing 46. In addition to the potentiometer 40 and the compressed air outlets 14, 32 and 44, on the controller housing 46, a compressed air feed or inlet fitting 48 is connected to an external source of compressed air (not shown). The compressed air fitting 48 is connected through a regulator or pressure reduction valve or other pressure regulating device 49 and a solenoid valve 60 to an internal source air line 62. A master switch 64 on the controller housing 46 controls the valve 60 to turn on and off the source air. The master switch 64 also simultaneously turns on and off a power supply (not shown) connected to the potentiometer 40. The controller 2 also includes a mode selector 66, a manually adjustable first feed air adjustment device or valve 68, a feed air meter 70, a manually adjustable supplemental air adjustment device or valve 72, an automatically adjustable second feed air device or valve 78, an automatically adjustable supplemental air device or valve 82, a total air pressure flow meter 84, an electrode air adjustment valve 88 and an electrode air flow meter 90.

The first feed air valve 68 and the supplemental air valve 72 may be, for example, adjustable pressure regulators or flow restrictors or proportional regulators or proportional valves or similarly functioning manually adjustable air flow control devices. The automatic second feed air valve 78 and the automatically adjustable supplemental air valve 82 are remotely adjustable and may be in the form of an adjustable pressure regulator or an adjustable flow restrictor or similarly functioning automatically adjustable air flow control devices. The feed air meter 70 is connected either to or downstream of the feed air outlet 14 and may be either a pressure meter or a flow meter. By connecting the feed air flow meter 70 to or downstream from the feed air outlet 14, only a single such device is needed for both manual and automatic operation for measuring the pressure and/or flow velocity and/or flow rate per unit of time and/or total flow rate of the feed air. Although not illustrated, it will be appreciated that a supplemental air meter similar to the feed air meter 70 may be connected to or downstream of the supplemental air outlet 32. The total air pressure flow meter 84 is preferably a float type flow meter in a compressed air feed line 86 for measuring the total compressed air flow to the injector 6 comprised of feed air and supplemental air flowing from the compressed air line 62 via a compressed air feed line 86 to a compressed air inlet "P" on the mode selector 66. The electrode air flow meter 90 also is preferably a float type flow meter.

The mode selector 66 is either manually or remotely controlled to allow changeover between manual and automatic operation of the powder spray device 8. For remote changeover, the mode selector 66 can be controlled either electrically or pneumatically or hydraulically. The mode selector 66 includes a valve which selectively connects the compressed air inlet "P" either to a compressed air outlet "H" in the manual operating mode or to a compressed air outlet "A" in the automatic operating mode. An electrode air flow path 92 is shown as extending from the internal compressed air line 62 via the electrode air flow meter 90 and the electrode air adjustment valve 88 to the electrode air outlet 44. According to a modified embodiment of the invention (not shown), the electrode air could be passed also to the mode selector 66 where it could be turned on and off.

A first feed air path 94 for manual operation which connects to the manual operation compressed air outlet "H" on the mode selector 66 includes a manual operation compressed air line 95. From the compressed air outlet "H", the air line 95 connects to the first feed air adjustment valve 68. From the valve 68, air flows through a first OR valve 96 to the feed air outlet 14. The feed air meter 70 is shown connected between the feed air OR valve 96 and the feed air outlet 14. A second feed air path 98 for automatic operation extends from the automatic operation compressed air outlet "A" on the mode selector 66 via an air line 99 to the automatic operation second feed air adjustment valve 78. The second feed air adjustment valve 78 is connected to deliver feed air through the first OR valve 96 to the feed air outlet 14. The first OR valve 96 is automatically switched by the feed air pressure so that it connects only the one feed air path 94 or 98 to the feed air outlet 14 in which feed air is being supplied, while simultaneously closing the other feed air path 98 or 94.

A first supplemental air path 100 for manual operation includes an air line 100 which extends from the manual operation air line 95 via the first supplemental air adjustment valve 72 to a first compressed air inlet of a second OR valve 102 and from the valve 102 to the supplemental air outlet 32. In a second supplemental air path 104 for automatic operation, air flows from the line 99 through the automatic air adjustment valve 82 to a second compressed air inlet of the second OR valve 102 and then to the supplemental air outlet 32. The second OR valve 102 connects only the one of the two supplemental air paths 100 or 104 in which supplemental air is being fed to the supplemental air outlet 32. The second OR valve 102 closes its compressed air inlet for the air path 104 or 102 which is not supplying supplemental air to the spray device 8.

Manual Operation

Figure 2:
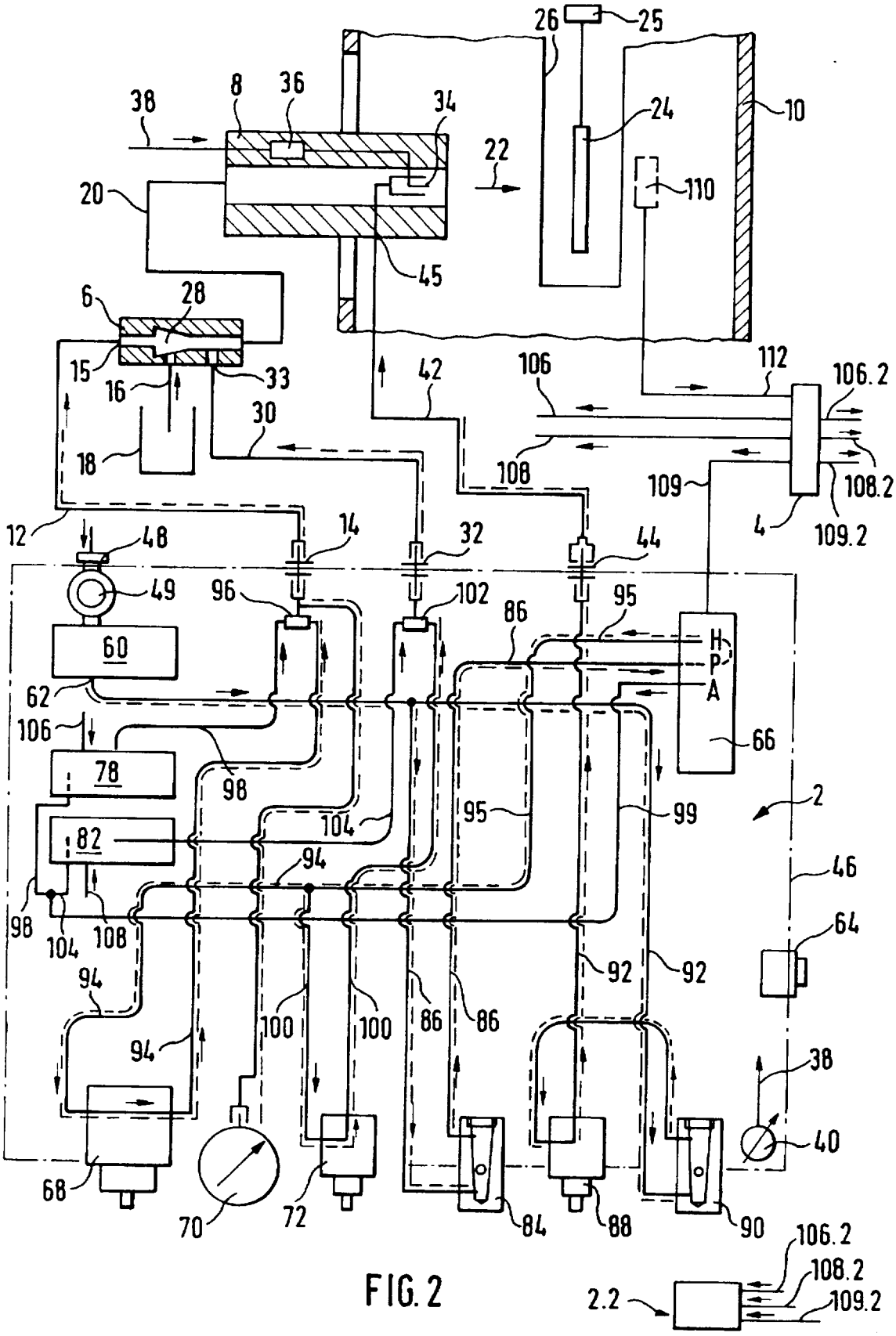
FIG. 2 shows the powder spray coating device of FIG. 1 in a manual operating mode, with the dashed lines indicating the lines carrying compressed air.

FIG. 2 shows the powder spray coating device when operated in the manual mode. Dashed lines are provided in FIG. 2 to show the air flow when the mode selector 66 is set for manual operation. The mode selector 66 allows compressed air to proceed form the compressed air line 62 via the total air flow meter 84 and the feed air line 86 to the compressed air outlet "H" on the mode selector 66. No air flows to the mode selector outlet "A". As a result, feed air flows only via the first manual operation feed air adjustment valve 68 to the feed air outlet 14 and no air flows to the second automatic operation feed air adjustment valve 78. Supplemental air flows only via the first manual operation supplemental air adjustment valve 72 to the supplemental air outlet 32 and no air flows to the second automatic operation supplemental air adjustment valve 82. The mode selector 66 can be set manually or by the master control device 4 to either manual or automatic operation. A home or initial position of the mode selector 66 is manual operation. This a advantageous in case of a failure of the control device 4. While in the manual operating mode, the operator adjusts the feed air flow by manually adjusting the feed air valve 68 and adjusts the supplemental air flow by manually adjusting the supplemental air valve 72. These valves 68 and 72 are adjusted in a manner similar to adjustments made by operators of prior art powder spray coating systems for adjusting the powder feed and the supplemental air flow rates to the injector 6.

Automatic Operation

Figure 3:
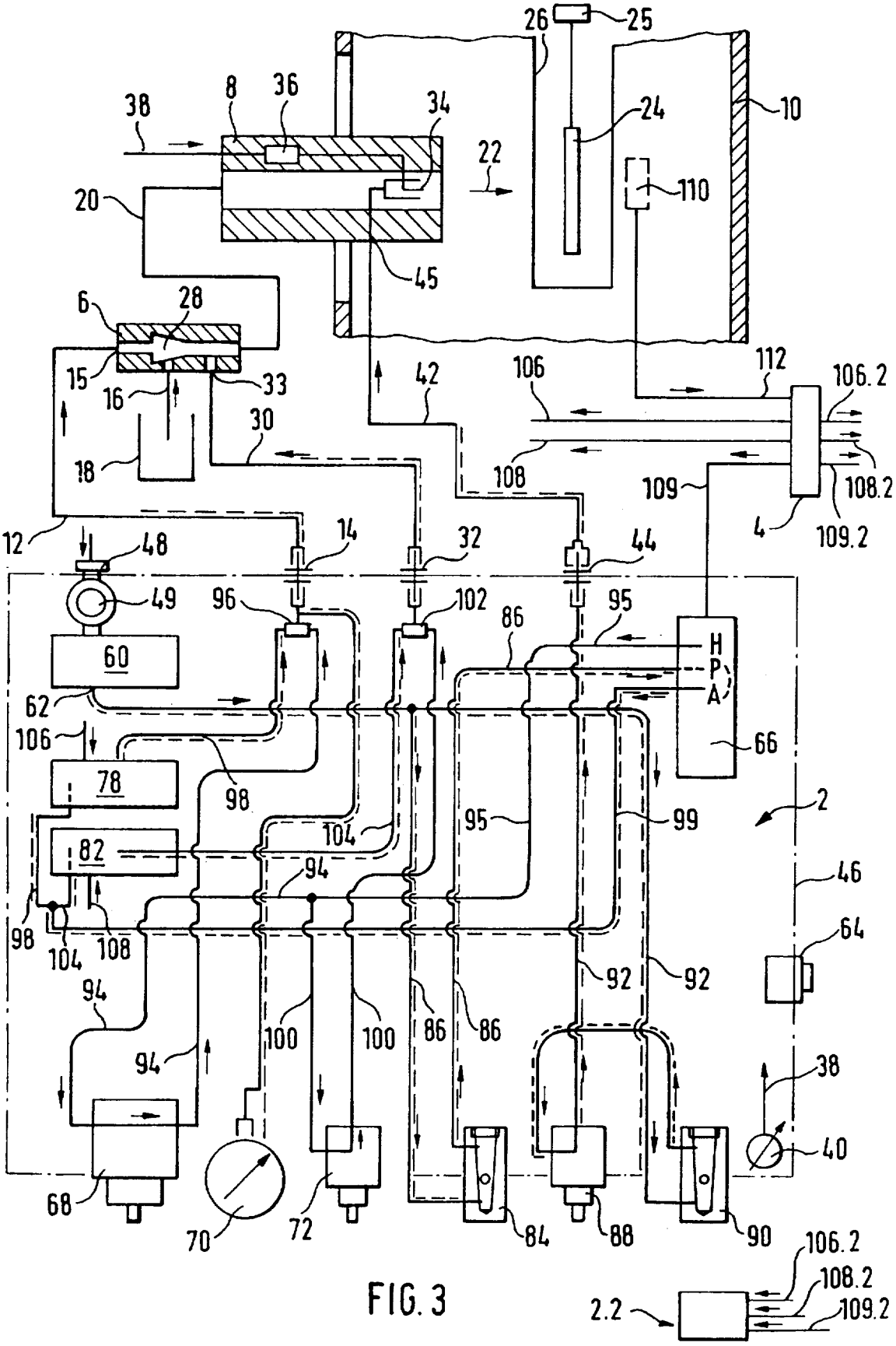
FIG. 3 shows the powder spray coating device of FIG. 1 in an automatic operating mode, with the dashed lines indicating the lines carrying compressed air.

FIG. 3 shows the powder spray coating device when operated in the automatic operation mode, with the lines carrying the compressed air indicated by added dashed lines. The mode selector 66 is set to select the automatic operation mode. Compressed air proceeds from the internal compressed air line 62 to the air feed line 86 via the compressed air inlet "P" and the compressed air outlet "A" on the mode selector 66, while the outlet "H" is closed. In the automatic operation mode, feed air can proceed only via the automatic operation feed air adjustment valve 78 in the second feed path 98 to the feed air outlet 14. Supplemental air can flow only via the automatic operation supplemental air adjustment valve 82 in the supplemental air flow path 104 to the supplemental air outlet 32. No air flows through the manual operation feed air adjustment valve 68 or through the manual operation supplemental air valve 72.

The automatic operation feed air adjustment valve 78 connects via an electric or pneumatic or hydraulic line 106 to the control device 4. The control device 4 controls the valve 78 by adjusting and/or regulating the pressure and flow rate of feed air, depending on the type of article being coated and/or the type of coating powder used and/or the rate at which the articles 24 are conveyed. The automatic supplemental air valve 82 is connected with a second electric, pneumatic or hydraulic line 108 to the control device 4. The valve 82 is controlled to set the supplemental air flow rate or pressure depending on the type and/or conveyor rate of the articles 24 being coated and/or the type of coating powder used and/or the desired flow rate and velocity of the coating powder. The type of coating powder can be entered manually in the control device 4 or can be retrieved from an internal memory by a computer program. The type of articles 24 to be coated also can be entered manually in the control device 4 or retrieved from an internal memory by a computer program or can be signaled by an article sensor 110 that is arranged beside the path of travel of the articles 24. Information identifying the presence and type of each article 24 is reported to the control device 4 which may be programmed with data needed to coat different articles.

Instead of only one spray device 8, several spray devices 8 may be connected to the feed air outlet 14, the supplemental air outlet 32 and the electrode air outlet 44. Moreover, it is possible to connect several controllers 2 to the control device 4. FIGS. 1–3 illustrate schematically, by way of example, a second control device 2.2 of the same design as the controller 2. The control device 2.2 is connected via appropriate lines 106.2, 108.2 and 109.2 to the control device 4, thereby supplying compressed air to additional spray devices 8 (not shown). The mode selectors 66 of all controllers 2 and 2.2, etc. each connect by way of the control lines 109, 109.2, etc. to the control device 4.

Figure 4:
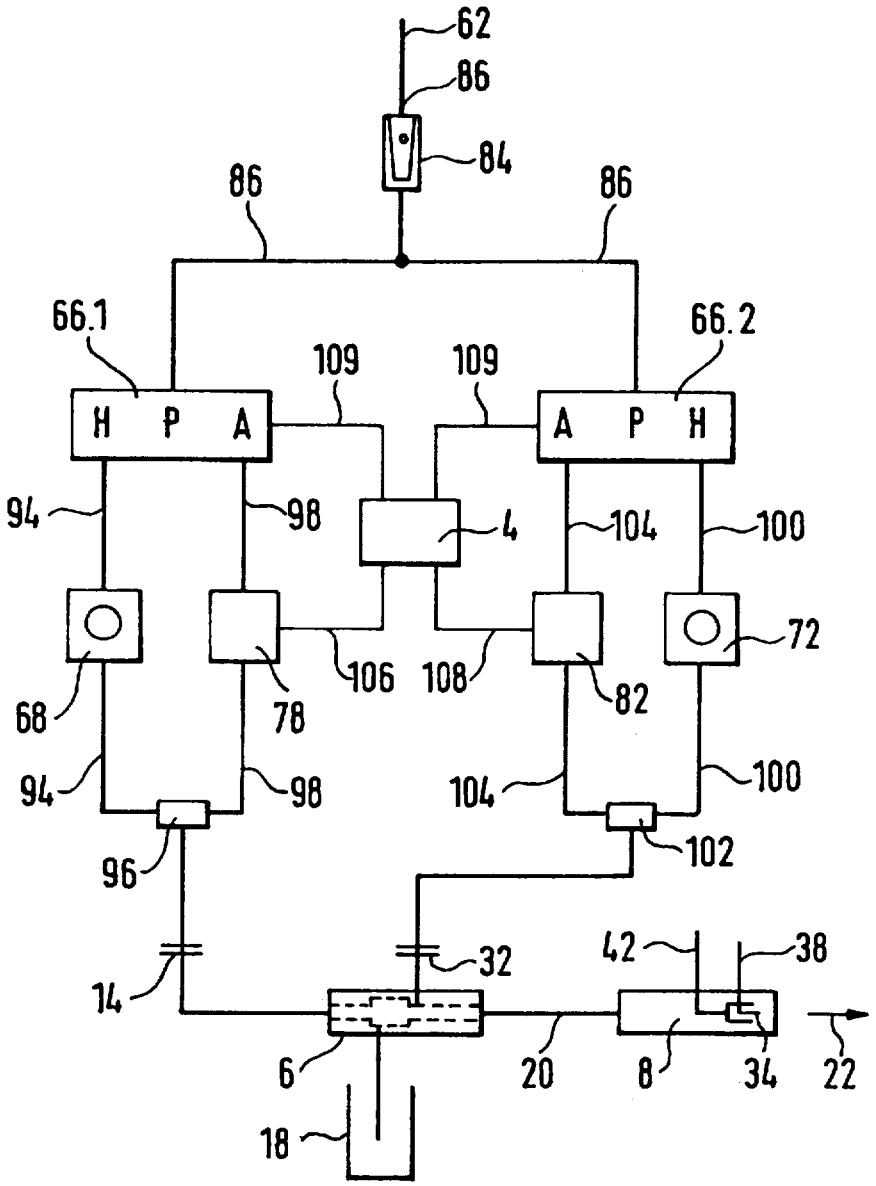
FIG. 4 is a schematic diagram of a further embodiment of a powder spray coating device according to the invention.

FIG. 4 illustrates a further embodiment of the powder spay coating device, except that two mode selectors 66.1 and 66.2 are used instead of only a single mode selector 66. One mode selector 66.1 controls the feed air and the other mode selector 66.2 controls the supplemental air. Since the other components and all functions are identical with those of the powder spray coating device of FIGS. 1–3, identical parts are identified with the same reference numbers and are not described in detail. Several of the parts have been omitted to simplify FIG. 4. In the manual operation mode, the feed air flows successively through the following components: the internal feed air line 62, the total air flow meter 84, the compressed air feed line 86, the feed air mode selector 66.1, the manual operation feed air adjustment valve 68, the first OR valve 96, the feed air outlet, the injector 6 and the spray device 8. In the automatic operation mode, compressed air flows from the air inlet line 62 through the total flow flow meter 84, the compressed air feed line 86, the feed air mode selector 66.1, the automatic feed air adjustment valve 78, the first OR valve 96, the feed air outlet 14, the injector 6 and the spray device 8. Similarly, the supplemental air flows in manual operation successively through the internal compressed air line 62, the total air flow meter 84, the compressed air feed line 86, the supplemental air mode selector 66.2, the manual operation supplemental air adjustment valve 72, the second OR valve 102, the supplemental air outlet 32, the injector 6 and the spray device 8. In automatic operation, the supplemental air flows successively from the internal compressed air line 62 through the total air flow meter 84, the compressed air feed line 86, the supplemental air mode selector 66.2, the automatic operation supplemental air adjustment valve 82, the second OR valve 102, the supplemental air outlet 32, the injector 6 and the spray device 8.

In place of the two OR valves 96 and 102, other known components which operate in the fashion of flow switches or valves may be used. The flow switches always connect at one time only one of two compressed air inlets to a compressed air outlet. The OR valves 96 and 102, and preferable the other switchable flow switches, are preferably designed such that they are switched automatically by the pressure of the compressed air being passed from one inlet to one outlet of the flow switch, while the respective other inlet of the flow switch is closed.

All of the electric components, functions and signals may be replaced by appropriate pneumatic or hydraulic components, functions or signals. It will be appreciated that various other modifications and changes may be made to the above described preferred embodiment of a powder coating device without departing from the scope of the following claims.

I claim:

1. In a powder spray coating device having at least one control unit which includes a feed air outlet adapted to be connected for supplying feed air to a powder injector feed pump in order to feed coating powder to a spray device, a first feed air path extending from an air inlet to said feed air outlet, a manually set first feed air adjustment valve located in said first feed air path for manually adjusting the flow of feed air in said first feed air path from said inlet to said feed air outlet, the improvement comprising a second feed air path which connects from said inlet to said feed air outlet, an automatically adjustable second feed air adjustment valve located in said second feed air path for automatically adjusting the flow of feed air in said second feed air path from said inlet to said feed air outlet, a selector located between said air inlet and said first and second feed air paths, said selector having a first setting connecting said air inlet to said first feed air path upstream of said first feed air adjustment valve and a second setting connecting said air inlet to said second feed air path upstream of said second feed air adjustment valve, and control means for automatically adjusting said second feed air adjustment valve when said selector is in said second setting.

2. An improved powder spray coating device, as set forth in claim 1, and wherein said control unit further includes a supplemental air outlet adapted to be connected for supplying feed air to or downstream of the powder injector feed pump, a first supplemental air path connected between said selector and said supplemental air outlet, a manually set first supplemental air adjustment valve located in said first supplemental air path for manually adjusting the flow of feed air in said first supplemental air path, a second supplemental air path connected between said selector and said supplemental air outlet, an automatically set second supplemental air adjustment valve located in said second supplemental air path for automatically adjusting the flow of feed air in said second supplemental air path, and wherein said selector is connected to deliver air from said air inlet to said first feed air path and said first supplemental air path when in said first setting and to deliver air from said air inlet to said second feed air path and said second supplemental air path when in said second setting, and wherein said control means adjusts said second supplement air adjustment valve when said selector is in said second setting.

3. An improved powder spray coating device, as set forth in claim 2, and further including a flow meter located in a compressed air supply line connected between said air inlet and said selector, said flow meter indicating the total feed air flow and supplemental air flow to said feed air outlet and said supplemental air outlet.

4. An improved powder spray coating device, as set forth in claim 2, and further including first flow switch means for selectively connecting one of said first and second feed air paths to said feed air outlet, and second flow switch means for selectively connecting one of said first and second supplemental air paths to said supplemental air outlet.

5. An improved powder spray coating device, as set forth in claim 2, and further including a sensor adapted for detecting articles to be coated, and wherein said control means adjusts said second feed air adjustment valve and said second supplemental air adjustment valve in response to said sensor detecting an article to be coated.

6. An improved powder spray coating device, as set forth in claim 2, and wherein said selector is initially in said first setting.

7. An improved powder spray coating device, as set forth in claim 1, and further including first flow switch means for selectively connecting one of said first and second feed air paths to said feed air outlet.

8. An improved powder spray coating device, as set forth in claim 1, and further including a sensor adapted for detecting articles to be coated, and wherein said control means adjusts said second feed air adjustment valve in response to said sensor detecting an article to be coated.

9. An improved powder spray coating device, as set forth in claim 1, and wherein said selector is initially in said first setting.

* * * * *